United States Patent [19]

Clausser

[11] 4,157,684

[45] Jun. 12, 1979

[54] SAFETY FILLER FOR UNDERLOADED FIREARM CARTRIDGE

[76] Inventor: Karl C. Clausser, 695 LaCadena Dr., Riverside, Calif. 92501

[21] Appl. No.: 780,796

[22] Filed: Mar. 24, 1977

Related U.S. Application Data

[63] Continuation-in-part of Ser. No. 615,929, Sep. 23, 1975, abandoned.

[51] Int. Cl.[2] ..... F42B 5/22

[52] U.S. Cl. ..... 102/38 R; 102/41

[58] Field of Search ..... 102/38 R, 41, 92.7

[56] References Cited

U.S. PATENT DOCUMENTS

| | | | |
|---|---|---|---|
| 788,266 | 4/1905 | King et al. | 102/41 |
| 1,902,771 | 3/1933 | Gaidos | 102/41 |

FOREIGN PATENT DOCUMENTS

| | | | |
|---|---|---|---|
| 1290452 | 3/1969 | Fed. Rep. of Germany | 102/41 |
| 10619 | 6/1909 | France | 102/41 |
| 1018410 | 1/1966 | United Kingdom | 102/41 |

*Primary Examiner*—Verlin R. Pendegrass
*Attorney, Agent, or Firm*—Herbert E. Kidder

[57] ABSTRACT

A safety filler for underloaded firearm cartridges, in which the volume of powder is less than the volumetric capacity of the powder chamber. The filler comprises a sleeve that is inserted into the powder chamber, which radially reduces the typical interior volume of a cartridge shell so that a lesser amount of powder charge fills the remaining space to about 90% of its available capacity. Being preferably made of a flexible and resilient material, the filler sleeve can be inserted into a cartridge shell having a necked-down configuration. The specific configuration of the filler sleeve provides for a reduced volume powder chamber within the cartridge to allow an even distribution of the powder which will burn evenly and uniformly, allowing safe firing of the bullet.

2 Claims, 6 Drawing Figures

SAFETY FILLER FOR UNDERLOADED FIREARM CARTRIDGE

BACKGROUND OF THE INVENTION

This application is a continuation-in-part of application Ser. No. 615,929, filed Sept. 23, 1975, and now abandoned.

The present invention pertains to firearm cartridges, and more particularly to a safety filler for use in underloaded firearm cartridges. The term "underloaded" as used in the application may be defined as a cartridge case in which the used or proposed powder charge does not fill the powder chamber to its full volumetric capacity. The cardinal maxim of loading firearm cartridges is that the load should fill the case. Obviously, a reduced load will always be less than the amount of powder required to fill the case. However, depending upon the characteristics of the powder used, a full load may completely fill the powder chamber, or it may be less in volume than the amount required to fill the chamber. For example, a slow burning powder of the type used in larger rifle cartridges will generally fill the case to capacity, when loaded to a full charge. These are a number of powders of high bulk density, such as Unique, or 2400, which, if used in full charge with respect to the pressure developed, will fill the case only partially. Such powders require a wad of fiber or other material to hold the charge in the back end of the case and against the flash-hole to insure proper ignition. Slower powders, however, should not be reduced in volume to less than 90% of the powder space of the cartridge, as most experts warn of this practice because of the danger of blow-up of the firearm.

The present invention is concerned with all loads not filling the cartridge case to capacity, or at least to 90% of total capacity. This includes both reduced loads, and full charges of a type of powder of high density which only partially fills the case. A full charge, in terms of internal ballistics, is the powder charge that produces the maximum pressure that a particular firearm is designed to tolerate. Thus, a full charge might fill the cartridge case completely, or only partially, but a reduced load will always occupy less volume than the full load of the same powder.

There are a number of problems associated with underloaded cartridges, due to the airspace within the case resulting from using less powder than the amount required to fill the case to capacity. Among these problems are: misfires; irregular burning of the powder charge; wide variation in bullet velocity, depending on placement and diffusion of powder, i.e., whether it is at the front or back of the case, or evenly distributed; and detonation, or explosive burning of the powder charge, which creates tremendous, unpredictable and erratic pressures that have been known to blow up a firearm and inflict serious injury on the shooter.

The use of underloaded cartridges has increased in recent years, particularly with respect to high-powered firearms which are used for target shooting, or small game hunting, where the full power of the firearm is not needed. This is especially true when cartridges are reloaded for target or small game use, as it allows the operator to load more cartridges with a given amount of powder.

Firearm owners have devised various methods and approaches for reducing the powder load in the cartridge chamber. One approach to the problem has been to use some type of wadding or paper material, which is usually placed at the front end of the case, just behind the bullet, in order to hold the reduced powder charge against the flash hole, without however significantly reducing the dead air space in the powder chamber. This has not been entirely satisfactory, as it sometimes produces erratic burning of the powder, with unpredictable results.

Another method of reducing the load or charge in a firearm cartridge has been the use of cornmeal to occupy some of the volume in the cartridge shell, and thereby to reduce the amount of powder necessary. However, small particles of cornmeal can become lodged in the anvil of the primer, Furthermore, when cornmeal particles are moist, they have been found to clog the flash-hole of the firearm to some extent, which leads to serious complications as a result of uneven burning of the powder charge. A significant inconvenience of the prior methods of reducing the powder load is the necessity of having to incorporate the reducing means at each reloading of the cartridge.

The most serious drawback to the use of prior art approaches to reducing the lower load of a cartridge is related to their inability to produce an even-burning powder charge of a reduced volume in the firearm cartridge powder chamber. It is the uneven burning of the powder charge which results in deleterious pressure characteristics in the firearm cartridge that cause damaging or catastropic explosions within the firearm.

SUMMARY OF THE INVENTION

The primary objects of the present invention are to provide an underloaded cartridge and method of making the same, which: eliminates dead airspace, resulting in fully loaded cases; improves internal ballistics; insures positive ignition of powder and uniform burning; prevents the creation of unpredictable deleterious pressures experienced particularly with reduced loads of slow-burning powders; prevents overfilling or doublecharging of cases; increases economy and efficiency by allowing powder-and-bullet combinations (or loads) not possible until now; can be used repeatedly; will not hinder usual reloading operations; and can be used for new manufacture of ammunition or by individual reloaders.

These objects are achieved in the present invention by providing a sleeve member which is inserted within the cylindrical powder chamber of the firearm cartridge to uniformly reduce the interior volume of the powder chamber concentrically and radially to produce a smaller powder chamber within the cartridge that can be completely filled with a less-than-maximum charge of powder, thereby improving the internal ballistics of the cartridge and promoting even burning of the powder. When inserted within the powder chamber of the cartridge, the sleeve has a tubular shape and the thickness of this tube provides the filler within the cartridge powder chamber, reducing the volume remaining to receive the powder charge. The reduced volume space within the cartridge established by the filler sleeve extends the longitudinal length of the cartridge between the primer and the bullet. Consequently, there is an even distribution of the reduced powder charge throughout the length of the cartridge to give the desired even burning of the powder charge, producing the desired safe pressure characteristics for the proper firing of the bullet.

Because most high-caliber firearm cartridges have a necked-down portion at the end connected with the bullet, the filler sleeve of the present invention is flexible and resilient, so that it may be longitudinally compressed or folded for insertion through the necked-down portion of the cartridge and will subsequently expand radially outward to occupy uniformly the outer radial space of the powder chamber. In some instances, where the cartridge does not have a necked-down portion, it is envisioned that the filler sleeve need not have the flexible and resilient characteristics for placement within the cartridge shell. Furthermore, it should be noted that the filler may be established by the uniform application of a coating material on the interior surface of the cartridge powder chamber to a specified thickness.

The filler provides the firearm owner with the ability to reduce the powder charge in a high-powered cartridge, so that he may vary the capability of his firearm to correspond with its intended use. The individual thus accomplishes a practical transformation of his firearm to meet the reduced-power requirements for a particular use, while at the same time deriving the economic benefit of using less powder in his ammunition cartridge, eliminating unnecessary waste of powder, and providing a high degree of safety for himself and his firearm while using reduced loads.

In addition, the present invention has the advantage of providing a permanent means of reducing the volume of the powder chamber in a cartridge, so that it may be continually re-used as a reduced-load, or underloaded, cartridge. This eliminates the necessity at each reloading of the cartridge of having to insert a material for reducing the volumetric capacity of the cartridge to accommodate a reduced load.

DESCRIPTION OF THE PREFERRED EMBODIMENT

Figure 1:
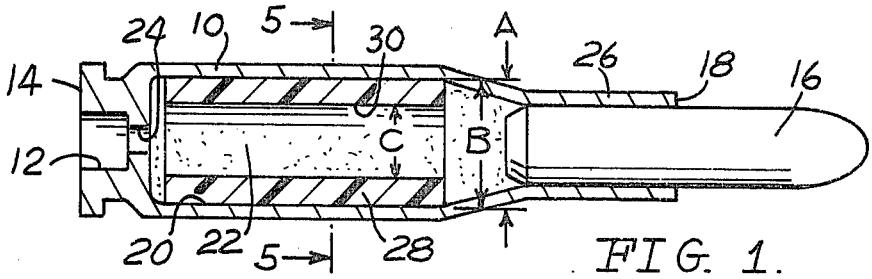
FIG. 1 is a partial sectional view of a firearm cartridge with the filler sleeve of the invention inserted within the powder chamber.
Figure 2:
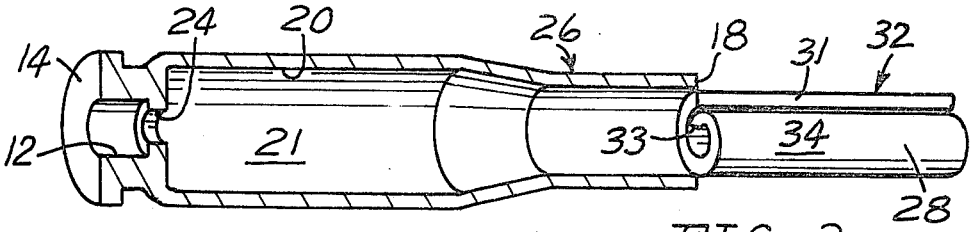
FIG. 2 is a perspective sectional view of a firearm cartridge with one embodiment of the filler sleeve invention.

A typical high-caliber firearm cartridge is shown in FIG. 1, with the cartridge shell 10, having a primer pocket 12 at one end 14 and a bullet or projectile 16 at the other end 18. Located within the cartridge shell 10, and shown more clearly in FIG. 2, is a powder chamber 20 which receives the powder charge 22 in FIG. 1 used to project the bullet 16 forward from the firearm when detonated by a primer which will be located in the primer pocket 12. The powder chamber 20 is in communication with the primer through the flash hole 24. Located at the other end 18 of the cartridge 10 is a necked-down portion 26 into which the bullet 16 is inserted with a tight press fit. This necked-down portion 26 has an interior diameter which is less than the diameter of the generally-cylindrical powder chamber 20.

Positioned within the powder chamber 20 is a filler sleeve 28 which has an outside diameter A substantially the same as the inside diameter B of the powder chamber 20. The filler sleeve 28 establishes a second or reduced-size powder chamber 30 having an inside diameter C substantially less than the inside diameter B of the powder chamber 20. Having the same general cylindrical shape, the second or reduced-diameter powder chamber 30 provides the same general cylindrical configuration of the powder chamber 20, but with a reduced volume. The filler sleeve 28 extends approximately the entire length of the generally cylindrical powder chamber 20 of the cartridge shell 10. When filled to not less than 90% of its capacity, the reduced powder chamber 30 has a minimum of dead air space (i.e, not more than 10%), and the powder is packed against the flash hole 24 at one end and against the rear end of the bullet at the other end.

Figure 5:
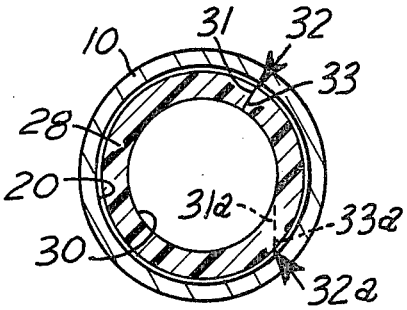
FIG. 5 is a sectional view, taken along line 5—5 in FIG. 1, showing in phantom the blunt edge junction of one filler sleeve embodiment.

In FIG. 2, one embodiment of the filler sleeve 28 is shown having a longitudinal slit 32, so that it may be rolled into a smaller diameter than that in FIG. 1, allowing insertion through the necked-down portion 26 and into the powder chamber 20. When the filler sleeve 28 is made for insertion into a firearm cartridge having a necked-down portion, it is preferable that it be made of a pliable and resilient plastic material, such as polyvinyl chloride or silicone. The material that is used must not be affected by the burning of the powder charge. It should be noted that, with respect to the filler sleeve 28 in FIG. 2, the longitudinal edges 31 and 33 of slit 32 are cut generally perpendicular to the surface 34 of the filler sleeve 28 when laid in a flat planar orientation. Consequently, when the filler sleeve is placed within the powder chamber 20, the respective longitudinal edges 31 and 33 of the filler sleeve mate in the orientation shown in solid lines in FIG. 5. Alternatively, the longitudinal edges of the filler sleeve may be cut at an obtuse angle with respect to the surface 34 when laid in flat planar orientation. As a result, the respective longitudinal edges **31*a* and 33*a* (shown in phantom lines in FIG. 5) of the slit 32*a* would provide the capability of overlapping to accommodate limited variations in the inside diameter of powder chamber 20, so that the filler sleeve could expand outward slightly if the inside diameter of the powder chamber 20** were larger, or contract inward if it were smaller.

Figure 3:
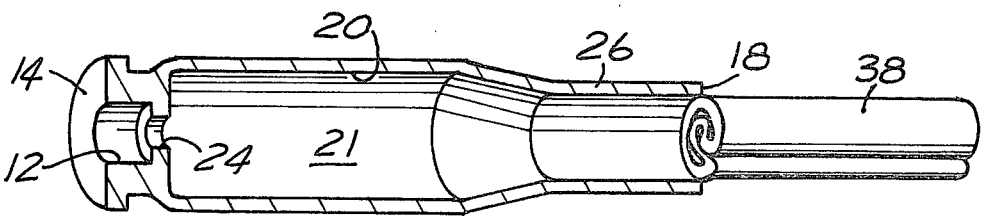
FIG. 3 is a perspective sectional view of a firearm cartridge with a second embodiment of the filler sleeve invention.
Figure 4:
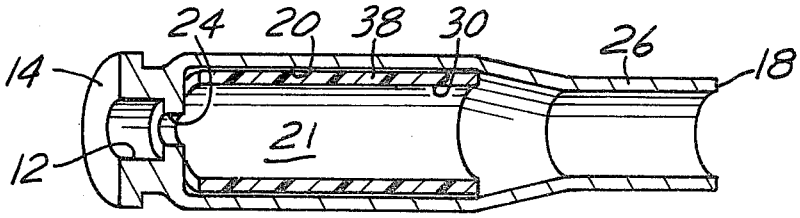
FiG. 4 is a perspective sectional view of the filler sleeve invention inserted within the firearm cartridge.

With reference to FIGS. 3 and 4, another embodiment of the filler sleeve is shown, which is constructed from a tubular piece of material that is pliable and resilient so that is can be folded longitudinally, as shown in FIG. 3, to allow for inserting the sleeve through the necked-down portion 26. The filler sleeve 38 has the advantage of being constructed from a tubular member not requiring the longitudinal slit 32 shown in FIG. 2. Once the filler sleeve 38 is completely inserted within the powder chamber 20, as shown in FIG. 4, it expands outwardly to occupy a concentric space adjacent the inside surface 21 of the powder chamber. Consequently, in the same manner as previously described, the filler sleeve 38 concentrically and radially reduces the volume within powderchamber 20 that is available for receipt of the powder charge 22.

Figure 6:
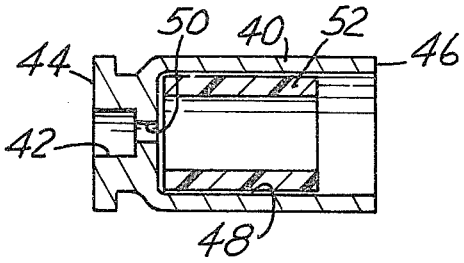
FIG. 6 is a sectional view of a small firearm cartridge having the filler sleeve in the powder chamber.

In FIG. 6, a smaller cartridge shell 40 is shown, having a primer pocket 42 at one end 44, while the other end 46 is designed to receive a bullet (not shown). Within the cartridge shell 40 is a powder chamber 48 designed to receive a powder charge for propelling a bullet forwardly when ignited by a primer within the primer pocket 42. A flash hole 50 provides communication between the primer and the powder charge within the powder chamber. Located within the powder chamber 48 is a filler sleeve 52 which reduces the internal volumetric capacity of the powder chamber 48 in the same manner as filler sleeves 38 and 28 reduce the internal volume of the powder chamber 20 in FIGS. 1–4. Consequently, a smaller volume remains for receipt of the powder charge to provide a more economical firing of the cartridge 40 when the power requirements are less for a particular use of the firearm. Because the bullet end 46 of the cartridge shell 40 is not necked down, the filler sleeve 52 would not require the same pliable and resilient material characteristics as required for the previous filler sleeves 28 and 38.

Turning to the method of using the above-described invention for the purpose of reducing the interior volume of the powder chamber in a shell, reference is made to FIGS. 1 and 2, where the primer is first placed within the primer pocket 12, after which a filler sleeve 23 is inserted into the empty powder chamber 20 of the cartridge shell 10 to the orientation shown in FIG. 1. The powder charge 22 is then loaded into the reduced-size powder chamber 30, and the bullet 16 is inserted into the necked-down portion 26. The cartridge is now ready for use. When the primer is detonated, the powder charge 22 will burn evenly and uniformly, to provide the desired safe pressure characteristics to propel the bullet forwardly with reduced power. Because the filler sleeve 28 is made of a material which will not be affected by the burning of the powder charge, the filler sleeve remains within the powder chamber for repeated reloadings of the shell.

It is envisioned that the powder chamber of the cartridge shell 10 could be reduced an amount similar to that accomplished with the filler sleeve 28 by the application of a thick coating of a suitable material uniformly on the interior surface 21 of the powder chamber. This type of filler would be permanent within the cartridge shell while the filler sleeves 28, 38 could be removed if desired.

By way of example, a filler sleeve having a wall thickness of 1.5 mm has been found to be satisfactory for a 0.30–06 cartridge, as it reduces the powder charge to about one-half the full charge.

A 1.5 mm thick sleeve could also be used with a 0.45 caliber cartridge, and likewise reduces the charge to about one-half the full charge. The burning rate of the reduced powder charge in the present invention is controlled and uniform, owing to the fact that the powder charge is centered within the cartridge and axially aligned with the primer flash hole 24. As a result, the reduced powder charge is quite safe, and accidental gun damage due to erratic burning of the powder is eliminated.

While I have shown and described in considerable detail what I believe to be the preferred form of my invention, it will be understood by those skilled in the art that the invention is not limited to such details, and that various changes may be made within the scope of the following claims.

What I claim is:

1. A reusable safety filler for use in an underloaded firearm cartridge of the type having a cylindrical case with a powder chamber and a necked-down front end portion into which a bullet is inserted, said case having a primer flash hole centered at the rear end thereof, and a powder charge contained within said powder chamber, said powder charge having a volume substantially less than about 90% of the full volumetric capacity of the case, said safety filler comprising:

an open-end tubular insert of a pliable material that is resistant to the combustion of the powder charge and can be contracted in diameter so as to allow it to be inserted through said necked-down portion into the powder chamber of the cartridge case, where it expands to lie against the inner surface of the powder chamber, said insert serving as a space filler and providing a central, reduced-volume powder chamber in which the powder is loaded to substantially 90% or more of the volumetric capacity of the reduced-diameter chamber, forming a packed cylindrical powder charge that is coaxial with both the flash hole and the bullet;

said powder charge being in direct contact with the flash hole for optimum ignition by the primer flash discharged from the flash hole, and the powder charge being in direct contact with the rear end of the bullet so that gas pressure generated by combustion of the powder acts directly against the bullet to propel the same forwardly.

2. A safety filler insert as in claim 1, wherein the edges of said piece of sheet material are cut at an obtuse angle with respect to the flat planar surface of the sheet material, so that when said edges are in contact with one another inside the cartridge case, said edges will slide over each other, allowing the insert to expand and contract radially so as to accommodate variations of the inside diameter or surface contours of the powder chamber in similar cartridge cases.

* * * * *